US010584592B2

(12) United States Patent
Tatton

(10) Patent No.: US 10,584,592 B2
(45) Date of Patent: Mar. 10, 2020

(54) PLATFORM FOR AN AIRFOIL HAVING BOWED SIDEWALLS

(71) Applicant: United Technologies Corporation, Farmington, CT (US)

(72) Inventor: Royce E. Tatton, Blackfoot, ID (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 718 days.

(21) Appl. No.: 14/948,624

(22) Filed: Nov. 23, 2015

(65) Prior Publication Data

US 2017/0145829 A1 May 25, 2017

(51) Int. Cl.

| | |
|---|---|
| ***F01D 5/14*** | (2006.01) |
| ***F01D 11/00*** | (2006.01) |
| ***F01D 5/02*** | (2006.01) |
| ***F01D 5/30*** | (2006.01) |

(52) U.S. Cl.

CPC ..... *F01D 5/147* (2013.01); *F01D 5/02* (2013.01); *F01D 5/3007* (2013.01); *F01D 11/008* (2013.01); *F01D 5/3053* (2013.01); *F05D 2220/32* (2013.01); *F05D 2220/36* (2013.01); *F05D 2230/31* (2013.01); *F05D 2240/80* (2013.01); *F05D 2250/11* (2013.01)

(58) Field of Classification Search

CPC ..... F01D 5/147; F01D 5/3007; F01D 5/02; F01D 11/008; F05D 2240/80; F05D 2230/31; F05D 2220/32

See application file for complete search history.

(56) References Cited

U.S. PATENT DOCUMENTS

| | | | | |
|---|---|---|---|---|
| 3,294,364 A * | 12/1966 | Stanley | F01D 5/3007 | 416/193 A |
| 3,694,104 A * | 9/1972 | Erwin | F01D 5/147 | 416/215 |
| 3,712,757 A * | 1/1973 | Goodwin | F01D 5/28 | 416/193 R |
| 4,621,979 A * | 11/1986 | Zipps | F01D 5/141 | 416/219 R |
| 5,049,035 A | 9/1991 | Marlin | | |
| 5,102,302 A * | 4/1992 | Schilling | B64C 11/04 | 416/134 A |

(Continued)

FOREIGN PATENT DOCUMENTS

| | | |
|---|---|---|
| EP | 2108785 | 10/2009 |
| EP | 3121386 | 1/2017 |

OTHER PUBLICATIONS

European Search Report, European Application No. 16200324.8, dated Apr. 6, 2017, European Patent Office; European Search Report 11 pages.

*Primary Examiner* — David E Sosnowski
*Assistant Examiner* — Wayne A Lambert
(74) *Attorney, Agent, or Firm* — Cantor Colburn LLP

(57) ABSTRACT

A platform for an airfoil in a gas turbine engine is provided. The platform includes a top wall configured to connect to an airfoil of the gas turbine engine, a connector configured to receive a pin and secure the platform to a rotor of the gas turbine engine, and a sidewall extending from the top wall to the connector, the sidewall having a first arm and a second arm, wherein the first arm and the second arm are curved such at a bowed sidewall extends from the top wall to the connector.

17 Claims, 5 Drawing Sheets

(56) References Cited

U.S. PATENT DOCUMENTS

| | | | | | |
|---|---|---|---|---|---|
| 5,193,982 | A * | 3/1993 | Inizan | F01D 11/008 | 416/193 A |
| 5,240,377 | A * | 8/1993 | Farr | B29C 70/083 | 416/224 |
| 5,281,096 | A * | 1/1994 | Harris | F01D 11/008 | 416/193 A |
| 6,217,283 | B1 * | 4/2001 | Ravenhall | F01D 5/225 | 415/9 |
| 6,447,250 | B1 * | 9/2002 | Corrigan | F01D 5/3007 | 416/193 A |
| 7,163,375 | B2 * | 1/2007 | Queriault | F01D 11/008 | 416/193 A |
| 7,878,763 | B2 * | 2/2011 | Keith | F01D 5/147 | 416/193 A |
| 8,568,102 | B2 * | 10/2013 | Menheere | F01D 5/3092 | 416/219 R |
| 8,777,576 | B2 * | 7/2014 | Kray | F01D 5/3007 | 416/190 |
| 8,939,727 | B2 * | 1/2015 | Campbell | F01D 11/008 | 416/193 A |
| 9,845,699 | B2 * | 12/2017 | Feeney | F01D 11/008 | |
| 2003/0012654 | A1 * | 1/2003 | Strassberger | F01D 5/3007 | 416/219 R |
| 2014/0003958 | A1 * | 1/2014 | Turner | F01D 11/008 | 416/244 A |
| 2014/0165398 | A1 * | 6/2014 | Giovannetti | B22F 5/04 | 29/889.71 |
| 2015/0300194 | A1 * | 10/2015 | Bottome | F01D 11/008 | 416/193 R |

* cited by examiner

PLATFORM FOR AN AIRFOIL HAVING BOWED SIDEWALLS

BACKGROUND

The subject matter disclosed herein generally relates to airfoil platforms used in gas turbine engines and, more particularly, to airfoil platforms having bowed sidewalls.

Gas turbine engines generally include a fan section, a compressor second, a combustor section, and turbine sections positioned along a centerline referred to as an "axis of rotation." The fan, compressor, and combustor sections add work to air (also referred to as "core gas") flowing through the engine. The turbine extracts work from the core gas flow to drive the fan and compressor sections. The fan, compressor, and turbine sections each include a series of stator and rotor assemblies. The stator assemblies, which do not rotate (but may have variable pitch vanes), increase the efficiency of the engine by guiding core gas flow into or out of the rotor assemblies.

The fan section includes a rotor assembly and a stator assembly. The rotor assembly of the fan includes a rotor disk and a plurality of outwardly extending rotor blades. Each rotor blade includes an airfoil portion, a dove-tailed root portion, and a platform. The airfoil portion extends through the flow path and interacts with the working medium gases to transfer energy between the rotor blade and working medium gases. The dove-tailed root portion engages attachment means of the rotor disk. The platform typically extends circumferentially from the rotor blade to a platform of an adjacent rotor blade. The platform is disposed radially between the airfoil portion and the root portion. The stator assembly includes a fan case, which circumscribes the rotor assembly in close proximity to the tips of the rotor blades.

To reduce the size and cost of the rotor blades, the platform size may be reduced and a separate fan blade platform may be attached to the rotor disk. To accommodate the separate fan blade platforms, outwardly extending tabs may be forged onto the rotor disk to enable attachment of the platforms. Fan platforms having either straight or more than one straight feature joined by blend radii may create high inter-laminar stresses due to high tensile loading through the fillets and a thin, fragile geometry may be needed for internal mold tools.

SUMMARY

According to one embodiment, a platform for an airfoil in a gas turbine engine is provided. The platform includes a top wall configured to connect to an airfoil of the gas turbine engine, a connector configured to receive a pin and secure the platform to a rotor of the gas turbine engine, and a sidewall extending from the top wall to the connector, the sidewall having a first arm and a second arm, wherein the first arm and the second arm are curved such that a bowed sidewall extends from the top wall to the connector.

In addition to one or more of the features described above, or as an alternative, further embodiments of the platform may include that the top wall defines a front end and a back end of the platform and the sidewall is a first sidewall located at the front end, the platform further comprising a second sidewall located at the back end.

In addition to one or more of the features described above, or as an alternative, further embodiments of the platform may include that the second sidewall comprises a first arm and a second arm, wherein the first arm and the second arm of the second sidewall are curved such that a bowed second sidewall is provided extending from the top wall to a second connector at the back end.

In addition to one or more of the features described above, or as an alternative, further embodiments of the platform may include a blend radius between the sidewall and the top wall.

In addition to one or more of the features described above, or as an alternative, further embodiments of the platform may include a stiffener extending from the top wall to the connector and located between first arm and the second arm of the sidewall.

In addition to one or more of the features described above, or as an alternative, further embodiments of the platform may include that the first arm and the second arm of the sidewall are bowed outward relative to an interior of the platform.

According to another embodiment, a method of manufacturing a platform for an airfoil in a gas turbine engine is provided. The method includes forming a top wall configured to connect to the airfoil of the gas turbine engine, forming a sidewall extending downward from the top wall, the sidewall having a first arm and a second arm, wherein the first arm and the second arm are curved such that a bowed sidewall extends from the top wall downward, with the first arm and the second arm extending toward each other, and forming a connector between the first arm and the second arm of the sidewall, the connector configured to receive a pin and secure the platform to a rotor of the gas turbine engine.

In addition to one or more of the features described above, or as an alternative, further embodiments of the method may include that the top wall defines a front end and a back end of the platform and the sidewall is a first sidewall located at the front end, the method further comprising forming a second sidewall located at the back end and extending downward from the top wall.

In addition to one or more of the features described above, or as an alternative, further embodiments of the method may include that the second sidewall comprises a first arm and a second arm, wherein the first arm and the second arm of the second sidewall are curved such that a bowed second sidewall is provided extending from the top wall to a second connector at the back end.

In addition to one or more of the features described above, or as an alternative, further embodiments of the method may include forming a blend radius between the sidewall and the top wall.

In addition to one or more of the features described above, or as an alternative, further embodiments of the method may include that the top wall, the sidewall, and the connector are formed substantially simultaneously.

In addition to one or more of the features described above, or as an alternative, further embodiments of the method may include that the top wall, the sidewall, and the connector are formed by additive manufacturing.

In addition to one or more of the features described above, or as an alternative, further embodiments of the method may include forming a stiffener extending from the top wall to the connector and located between the first arm and the second arm of the sidewall.

In addition to one or more of the features described above, or as an alternative, further embodiments of the method may include that the first arm and the second arm of the sidewall are bowed outward relative to an interior of the platform.

According to another embodiment, a gas turbine engine is provided. The engine includes a rotor, at least one airfoil, and a platform configured to connect the at least one airfoil to the rotor. The platform includes a top wall configured to connect to the at least one airfoil, a connector configured to receive a pin and secure the platform to the rotor, and a sidewall extending from the top wall to the connector, the sidewall having a first arm and a second arm, wherein the first arm and the second arm are curved such that a bowed sidewall extends from the top wall to the connector.

In addition to one or more of the features described above, or as an alternative, further embodiments of the engine may include that the top wall defines a front end and a back end of the platform and the sidewall is a first sidewall located at the front end, the platform further comprising a second sidewall located at the back end.

In addition to one or more of the features described above, or as an alternative, further embodiments of the engine may include that the second sidewall comprises a first arm and a second arm, wherein the first arm and the second arm of the second sidewall are curved such that a bowed second sidewall is provided extending from the top wall to a second connector at the back end.

In addition to one or more of the features described above, or as an alternative, further embodiments of the engine may include a blend radius between the sidewall and the top wall.

In addition to one or more of the features described above, or as an alternative, further embodiments of the engine may include a plurality of airfoils and a plurality of platforms configured to attach the plurality of airfoils to the rotor.

In addition to one or more of the features described above, or as an alternative, further embodiments of the engine may include that the first arm and the second arm of the sidewall are bowed outward relative to an interior of the platform.

Technical effects of embodiments of the present disclosure include a platform used in a gas turbine engine having bowed sidewalls. Further technical effects include a process of manufacturing a platform for a gas turbine engine that includes bowed sidewalls.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
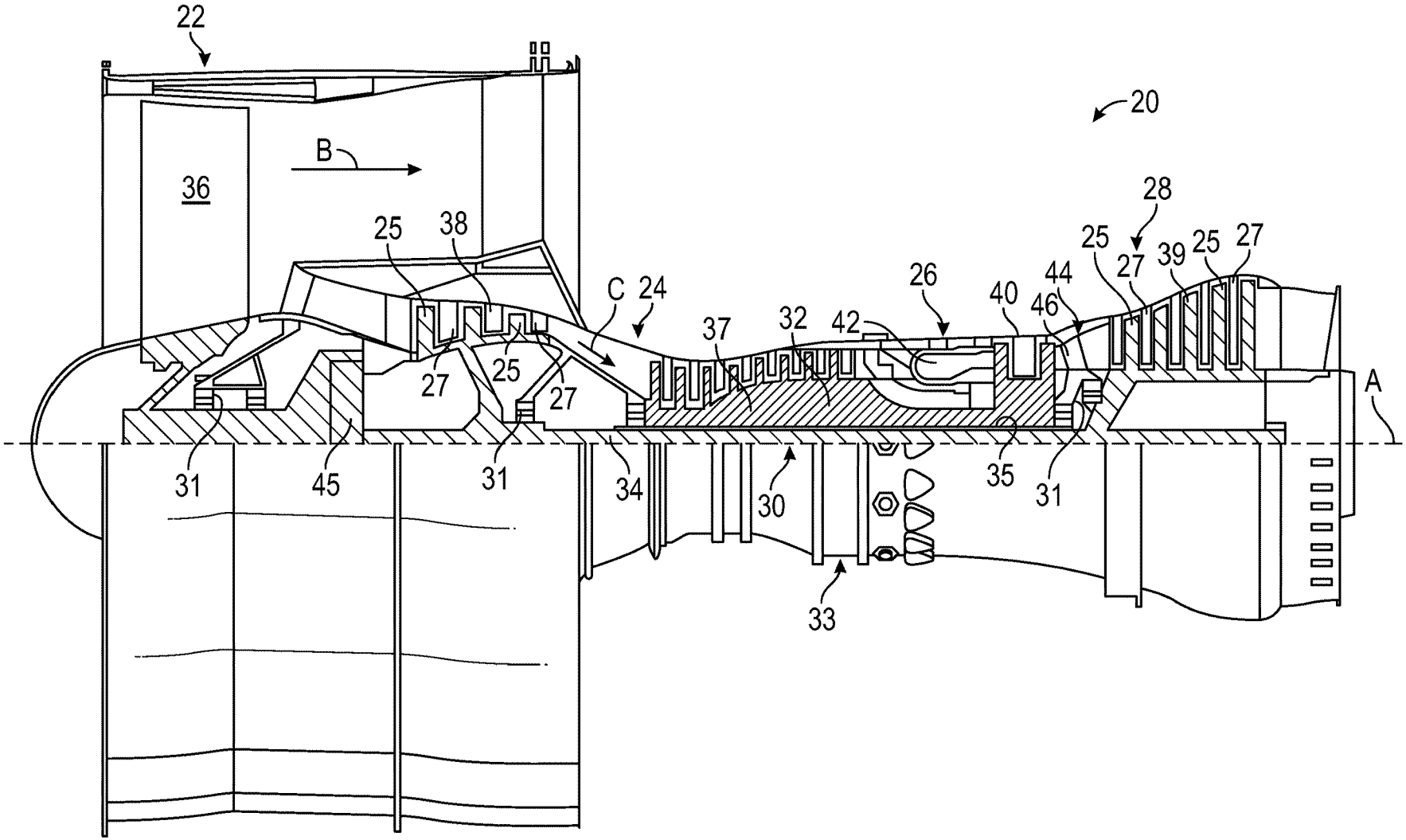
FIG. 1A is a schematic cross-sectional illustration of a gas turbine engine that may employ various embodiments disclosed herein.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}° R)/(518.7° R)]^{0.5}$, where $T_{ram}$ represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as partial cavity baffles are discussed below.

Figure 1B:
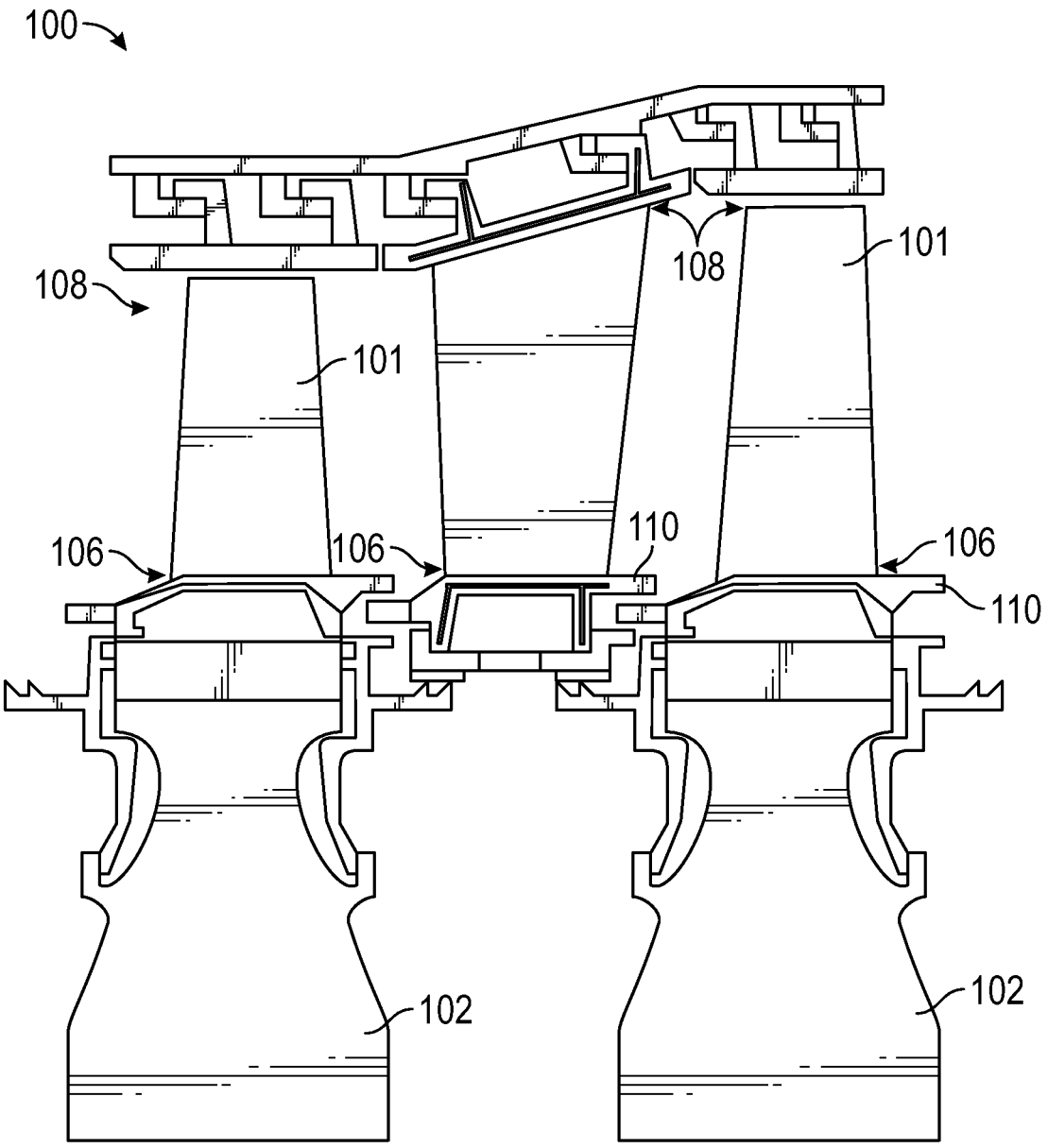
FIG. 1B is a schematic illustration of a turbine that may employ various embodiments disclosed herein.

FIG. 1B is a schematic view of a turbine section that may employ various embodiments disclosed herein. Turbine 100 includes a plurality of airfoils 101 that may be blades of rotor sections of a gas turbine engine. The airfoils 101 may be mounted to a rotor 102

The airfoils 101 may be hollow bodies with internal cavities defining a number of channels or cavities, hereinafter airfoil cavities, formed therein and extending from an inner diameter 106 to an outer diameter 108, or vice-versa. The airfoil cavities may be separated by partitions within the airfoils 101 that may extend either from the inner diameter 106 or the outer diameter 108 of the airfoil 101. The partitions may extend for a portion of the length of the airfoil 101, but may stop or end prior to forming a complete wall within the airfoil 101. Thus, each of the airfoil cavities may be fluidly connected and form a fluid path within the respective airfoil 101. The blades 101 and the vanes may include platforms 110 located proximal to the inner diameter thereof. The platforms 110 may provide a connection between the rotor 102 and the airfoil 101.

Figure 2:
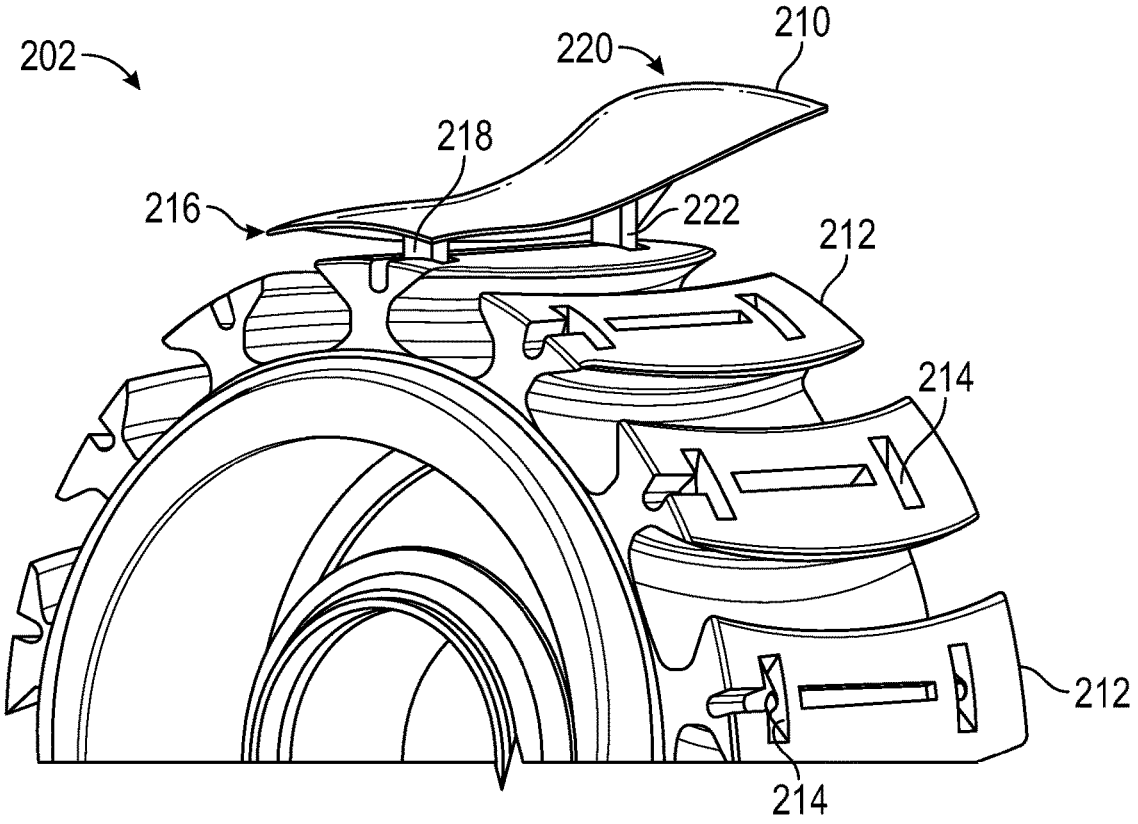
FIG. 2 is a perspective view of a fan rotor including a plurality of blade root attachment lugs and a blade platform.

Turning now to FIG. 2, illustrated is a perspective view of a fan rotor 202 that may be located within a fan section of a gas turbine engine. As shown, the fan rotor 202 includes at least one blade root attachment lug 212. During installation of the fan section, a fan blade platform 210 is operably coupled to each of the blade root attachment lugs 212. As shown, each of the blade root attachment lug 212 may include one or more slots 214 that are configured to receive a portion of a platform 210. For example, as shown, a front end 216 of the platform 210 may include a first connector 218 that may engage within a respective first cavity 214, and at back end 220 of the platform 210, a second connector 222 may engage with a respective second cavity 214. A locking pin (not shown) may be used to provide removable attachment between the platform 210 and the blade root attachment lug 212.

Figure 3:
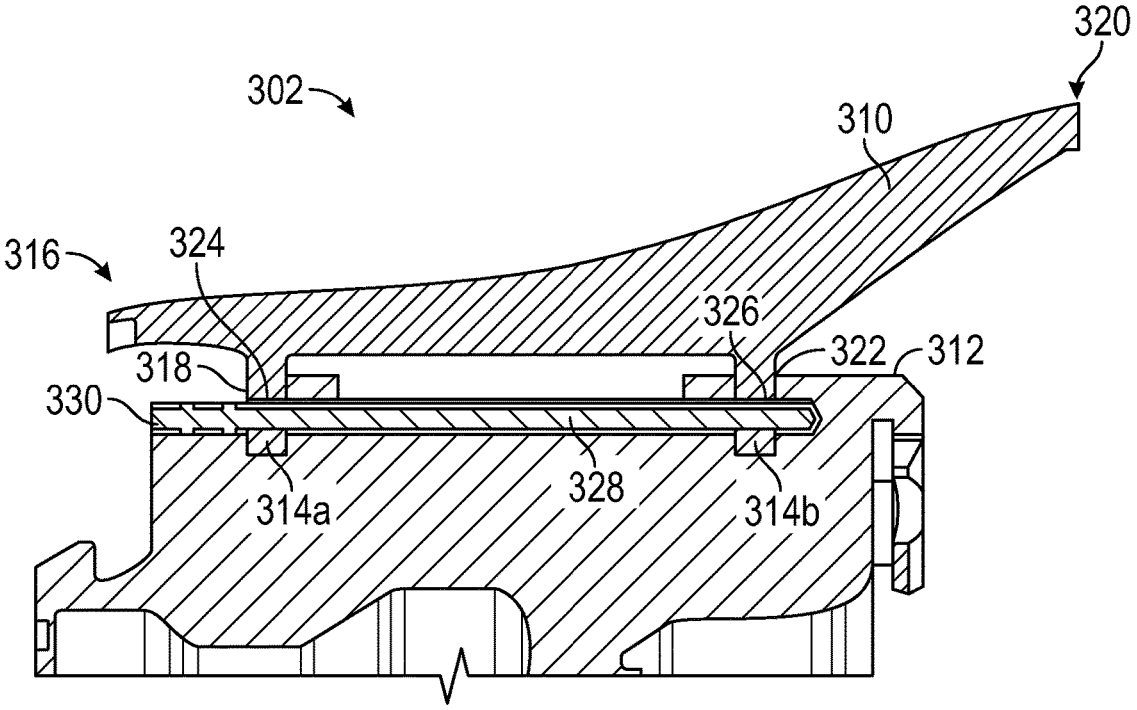
FIG. 3 is a cross-sectional illustration of a blade platform as engaged with a blade root attachment lug.

Turning now to FIG. 3, a cross-sectional schematic view of a portion of a fan rotor 302 is shown. During installation of a fan section of a gas turbine engine, a fan blade platform 310 may be operably coupled to each of the blade root attachment lugs 312 of the fan rotor 302. Each platform 310 may include at least one connector, e.g., first connector 318 and second connector 322, extending from a bottom of the platform 310. Each of the at least one connectors 318, 322 include an aperture 324, 326, respectively, formed therethrough.

To secure the platform 310 to a respective blade root attachment lug 312, the first connector 318 is inserted into a first cavity 314*a* at a front end 316, and the second connector 322 is inserted into a second cavity 314*b* at a back end 320. A pin 328 may be inserted through a blade root attachment lug aperture 330 to pass through each of the apertures 324, 326 of the platform 310 in the first connector 318 and the second connector 322.

Figure 4A:
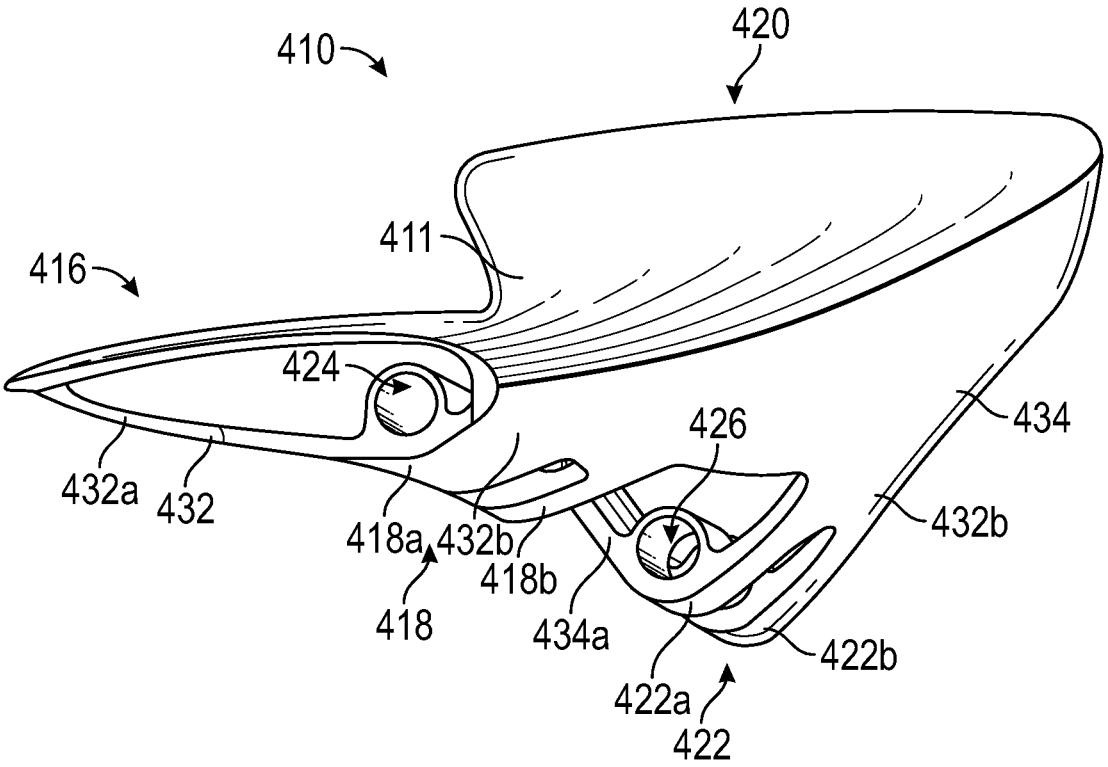
FIG. 4A is a perspective schematic illustration of a platform in accordance with an embodiment of the present disclosure.
Figure 4B:
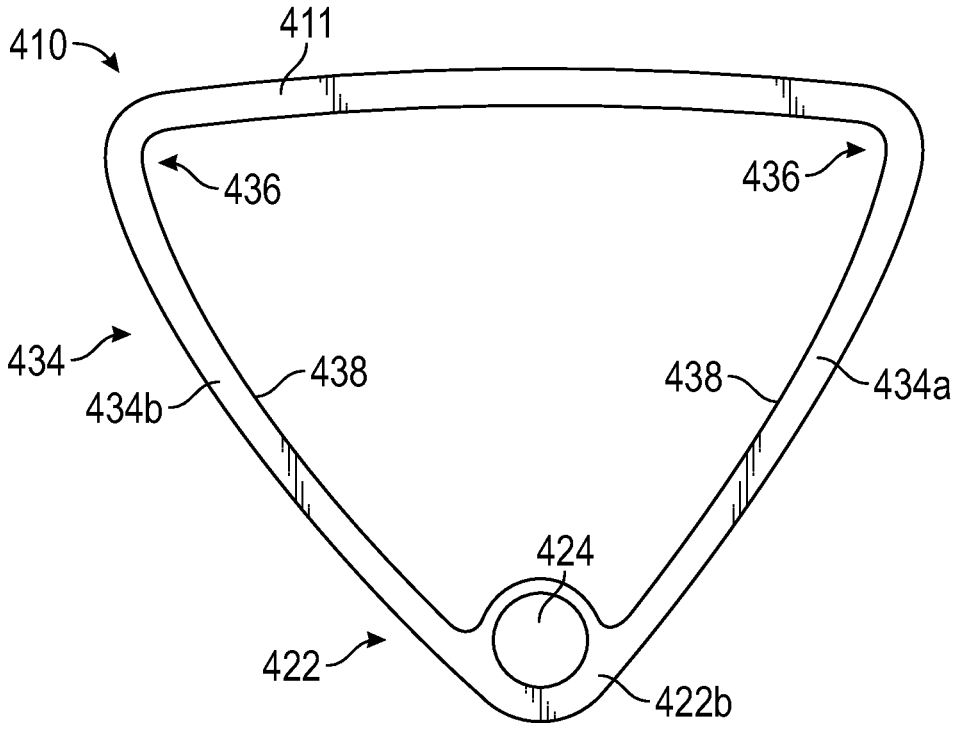
FIG. 4B is a rear elevation schematic illustration of the platform of FIG. 4A.

Turning now to FIGS. 4A and 4B, views of a platform 410 in accordance with a non-limiting embodiment of the present disclosure are shown. FIG. 4A is a perspective view of the platform 410 and FIG. 4B is a rear elevation view of the platform 410. The platform 410 may be installed and operated similar to the platforms described above.

Platform 410 includes a top wall 411 or flow path surface. A first sidewall 432, having two arms 432*a*, 432*b*, is located at a front end 416 of the platform 410 and extends downward from the top wall 411. A second sidewall 434, having two arms 434*a*, 434*b*, is located a rear end 420 of the platform 410 and extends downward from the top wall 411.

As shown, the top wall 411, the first sidewall 432, and the second sidewall 434 form a unitary body of the platform 410. The arms 432*a*, 432*b* of the first sidewall 432 join opposite the top wall 411 to form the first connector 418. Similarly, the arms 434*a*, 434*b* of the second sidewall 434 join opposite the top wall 411 to form the second connector 422. As shown in FIG. 4A, the first connector 418 may define two pin supports 418*a* and 418*b* and the second connector 422 may define two pin supports 422*a* and 422*b*. The pin supports 418*a*, 418*b* and 422*a*, 422*b* may define apertures 424 and 426, respectively, which receive a locking pin (not shown).

As shown, the sidewalls 432, 434 may be bowed or curved, as extending from the top wall 411 to the respective pin supports 418*a*, 418*b* and 422*a*, 422*b* of the connectors 418, 422, respectively. A blend radius 436 (shown in FIG. 4B) joins the sidewalls 432, 434 to the top wall 411. Under centrifugal loading, an inner surface 438 of the bowed sidewalls 432, 434 may go into tension due to movement inward and upward which in turn decreases the high tensile load through a flow path fillet. The bowed sidewalls 432, 434 allow for spreading a bending load over the entire sidewall 432, 434 while also enlarging the available real estate inside the platform for inner mold tooling, especially near the front end 416. The bowed sidewalls 432, 434 may further decrease interlaminar stresses to within material tolerances as compared to similar platform designs with straight sidewalls.

As shown in FIG. 4B, the sidewall 434 define a curvature or contour extending from the top wall 410 to the connector 422. That is, the arms 434*a*, 434*b* of the sidewall 434 may bow outward relative to a line extending from an edge of the top wall 410 and the connector 422. Outward, as used herein, is a direction away from an interior of the platform, the interior defined by interior surfaces of the top wall, the sidewalls, and the connector. As such, a straight wall construction is not used, but rather the sidewall 434 is curved.

Figure 5:
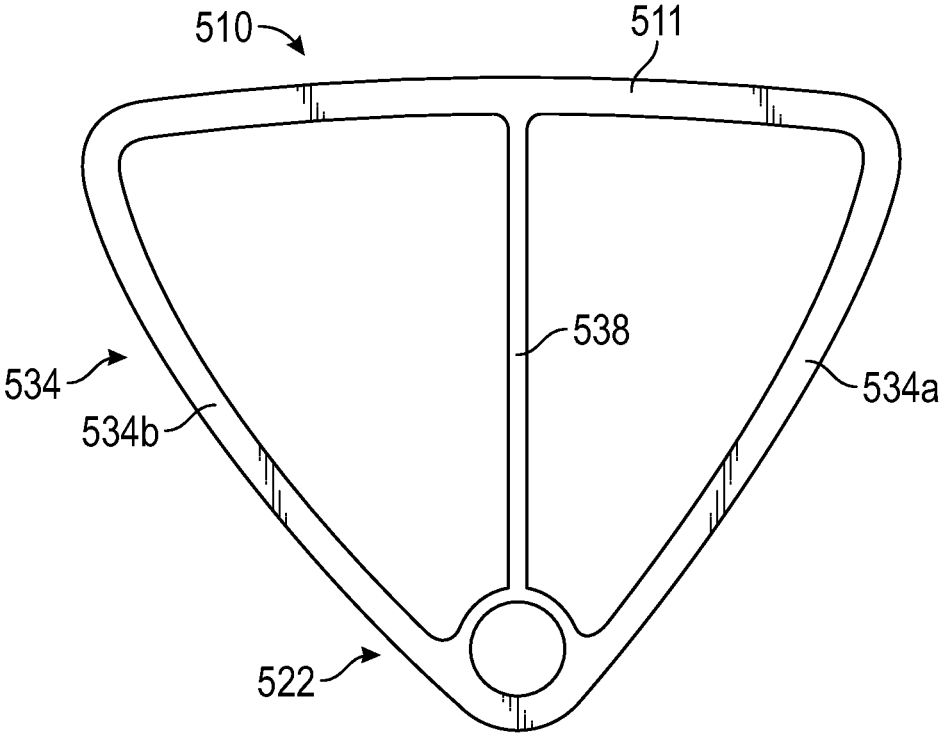
FIG. 5 is a rear elevation schematic illustration of a platform in accordance with another embodiment of the present disclosure.

Turning now to FIG. 5, an alternative configuration of a platform in accordance with the present disclosure is shown. The platform 510 shown in FIG. 5 may be substantially similar to the platform shown in FIGS. 4A and 4B. Thus, platform 510 includes a top wall 511 with two arms 534*a*, 534*b* forming a bowed sidewall 534. The two arms 534*a*, 534*b* connected with a connector 522. However, in the embodiment shown in FIG. 5, the platform 510 includes a stiffener 538 extending from the top wall 511 to the connector 522 at a position between the arms 534*a*, 534*b* of the sidewall 534.

Figure 6:
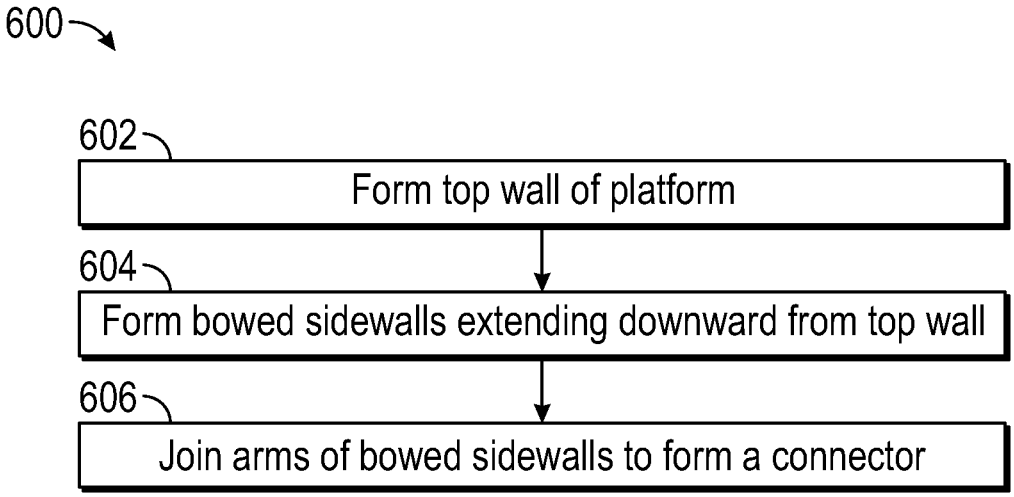
FIG. 6 is a process for manufacturing a platform in accordance with an embodiment of the present disclosure.

Turning now to FIG. 6, a process of manufacturing a platform in accordance with a non-limiting embodiment of the present disclosure is show. Process 600 may be employed to form a platform such as that shown in FIGS. 4A, 4B, or 5, having bowed or curved sidewalls.

At block 602, a top wall of the platform may be formed. This may be casting, molding, additive manufacturing, or other manufacturing technique. At block 604, bowed arms of sidewalls are formed that extend downward from the top wall and extend toward each other. At block 606, the arms of the sidewalls are joined to form a connector below the top wall. The connector may be formed with an aperture therethrough that is configured to receive a pin or other locking device. As will be appreciated by those of skill in the art, blocks 602-606 may be performed simultaneously depending on the manufacturing process, such as in molding, casting, or additive manufacturing. Further, in some embodiments, the connector may be formed first, and the bowed sidewalls may extend upward and outward therefrom, with the top wall being formed last. Thus, the order of the blocks 602-606 is not intended to be limiting, but rather is provided as an example manufacturing flow process. Moreover, additional steps and/or processes may be performed without departing from the scope of the present disclosure. For example, one or more stiffeners may be formed in the platform to provide additional structure and/or support to the platform.

Advantageously, embodiments described herein provide a platform for an airfoil in a gas turbine engine having bowed sidewalls that extend from a top wall of the platform to a pin connector of the platform. Advantageously, the bowed sidewalls may provide improved (i.e., decreased) interlaminar stresses within the platform. For example, the bowed sidewalls may include a blend radius proximal to the top wall, and thus the stresses may be decreased.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although shown an described with respect to example embodiments, those of skill in the art will appreciate that the configuration and structure of the platforms disclosed herein may be varied without departing from the scope of the present disclosure. For example, although a central interior area or volume of the platform is shown as hollow or empty (e.g., as shown in FIGS. 4A and 4B), those of skill in the art will appreciate that one or more vertical stiffeners may be included therein. For example, a vertical stiffener may extend from a pin support to an interior surface of the top wall.

Accordingly, the present disclosure is not to be seen as limited by the foregoing description, but is only limited by the scope of the appended claims.

What is claimed is:

1. A platform for an airfoil in a gas turbine engine, the platform comprising:

a top wall configured to provide a connection to the airfoil of the gas turbine engine, the platform enabling attachment of the airfoil to a rotor of the gas turbine engine, the top wall extending from a front end to a rear end;

a first connector and a second connector aligned to receive a pin and secure the platform to the rotor of the gas turbine engine, the first connector having an aperture and the second connector having an aperture, the apertures of the first and second connectors configured to receive the pin, wherein the first connector is proximate the front end and the second connector is proximate the rear end; and a first sidewall extending from the top wall to the first connector, the first sidewall having a first arm and a second arm, wherein the first arm and the second arm of the first sidewall are curved such that a bowed sidewall extends from the top wall to the first connector, wherein the first and second arms are proximate the front end; and a second sidewall extending from the top wall to the second connector, the second sidewall having a first arm and a second arm, wherein the first arm and the second arm of the second sidewall are curved such that a bowed sidewall extends from the top wall to the second connector, wherein the first and second arms of the second sidewall are proximate the rear end, wherein an interior of the platform is defined by interior surfaces of the top wall, the first and second sidewalls, and the first and second connectors, and wherein the first arm and the second arms of the first and second sidewalls are bowed outward relative to the interior of the platform.

2. The platform of claim 1, wherein the first connector comprises a first pin support and a second pin support arranged to support the pin when received in the first connector.

3. The platform of claim 1, wherein the second connector comprises a first pin support and a second pin support arranged to support the pin when received in the second connector.

4. The platform of claim 1, further comprising a blend radius between at least one of (i) the first sidewall and (ii) the second sidewall and the top wall.

5. The platform of claim 1, further comprising a stiffener extending from the top wall to the second connector and located between first arm and the second arm of the second sidewall.

6. A method of manufacturing a platform for an airfoil in a gas turbine engine, the method comprising:

forming a top wall configured to provide a connection to the airfoil of the gas turbine engine, the platform enabling attachment of the airfoil to a rotor of the gas turbine engine, the top wall extending from a front end to a rear end;

forming a first sidewall extending downward from the top wall, the first sidewall having a respective first arm and a respective second arm, wherein the first arm and the second arm of the first sidewall are curved such that a bowed sidewall extends from the top wall downward, with the first arm and the second arm extending toward each other, wherein the first and second arms are proximate the front end;

forming a second sidewall extending from the top wall, the second sidewall having a respective first arm and a respective second arm, wherein the first arm and the second arm of the second sidewall are curved such that a bowed sidewall extends from the top wall downward, with the first arm and the second arm of the second sidewall extending toward each other, wherein the first and second arms of the second sidewall are proximate the rear end;

forming a first connector proximate the front end between the first arm and the second arm of the first sidewall, the first connector configured to receive a pin and secure the platform to the rotor of the gas turbine engine; and forming a second connector proximate the rear end between the first arm and the second arm of the second sidewall, the second connector aligned with the first connector and configured to receive the pin and secure the platform to the rotor of the gas turbine engine, wherein an interior of the platform is defined by interior surfaces of the top wall, the sidewalls, and the connectors, and wherein the first arm and the second arm of each of the first sidewall and the second sidewall are bowed outward relative to the interior of the platform.

7. The method of claim 6, further comprising forming the first connector with a first pin support and a second pin support arranged to support the pin when received in the first connector.

8. The method of claim 6, further comprising forming the second connector with a first pin support and a second pin support arranged to support the pin when received in the second connector.

9. The method of claim 6, further comprising forming a blend radius between each of the first sidewall and the second sidewall and the top wall.

10. The method of claim 6, wherein the top wall, the first sidewall, the second sidewall, the first connector, and the second connector are formed simultaneously.

11. The method of claim 6, wherein the top wall, the first sidewall, the second sidewall, the first connector, and the second connector are formed by additive manufacturing.

12. The method of claim 6, further comprising forming a stiffener extending from the top wall to the second connector and located between the first arm and the second arm of the second sidewall.

13. A gas turbine engine comprising:

a rotor;

at least one airfoil; and a platform configured to connect the at least one airfoil to the rotor, the platform comprising:

a top wall configured to provide a connection to the at least one airfoil, the platform enabling attachment of the airfoil to the rotor, the top wall extending from a front end to a rear end;

a first connector and a second connector aligned to receive a pin and secure the platform to the rotor, the first connector having an aperture and the second connector having an aperture, the apertures of the first and second connectors configured to receive the pin, wherein the first connector is proximate the front end and the second connector is proximate the rear end;

a first sidewall extending from the top wall to the first connector, the first sidewall having a first arm and a second arm, wherein the first arm and the second arm of the first sidewall are curved such at a bowed sidewall extends from the top wall to the first connector, wherein the first and second arms of the first sidewall are proximate the front end; and a second sidewall extending from the top wall to the second connector, the second sidewall having a first arm and a second arm, wherein the first arm and the second arm of the second sidewall are curved such that a bowed sidewall extends from the top wall to the second connector, wherein the first and second arms of the second sidewall are proximate the rear end, wherein an interior of the platform is defined by interior surfaces of the top wall, the first and second sidewalls, and the first and second connectors, and wherein the first arm and the second arms of the first and second sidewalls are bowed outward relative to the interior of the platform.

14. The gas turbine engine of claim 13, first connector comprises a first pin support and a second pin support arranged to support the pin when received in the first connector.

15. The gas turbine engine of claim 13, wherein the second connector comprises a first pin support and a second ORO pin support arranged to support the pin when received in the second connector.

16. The gas turbine engine of claim 13, further comprising a blend radius between at least one of (i) the first sidewall and (ii) the second sidewall and the top wall.

17. The gas turbine engine of claim 13, further comprising a plurality of airfoils and a plurality of platforms configured to attach the plurality of airfoils to the rotor.

* * * * *